US005492422A

United States Patent [19]

Kondo

[11] Patent Number: 5,492,422

[45] Date of Patent: Feb. 20, 1996

[54] INK RIBBON CARTRIDGE

[75] Inventor: Shinichi Kondo, Miyagi, Japan

[73] Assignee: Sony Corporation, Tokyo, Japan

[21] Appl. No.: 285,220

[22] Filed: Aug. 3, 1994

[30] Foreign Application Priority Data

Aug. 6, 1993 [JP] Japan ..... 5-195047

[51] Int. Cl.[6] ..... B41J 35/28

[52] U.S. Cl. ..... 400/208.1; 400/207; 400/242; 400/246; 242/343.2; 242/345.2; 267/163

[58] Field of Search ..... 400/207, 208, 400/208.1, 234, 242, 246; 242/343.2, 345.2, 347, 423.1, 423.2; 267/158, 160, 163, 164, 165

[56] References Cited

U.S. PATENT DOCUMENTS 4,883,234 11/1989 Yamakawa et al. ..... 242/423.1
5,079,565 1/1992 Shimizu et al. ..... 400/208
5,110,228 5/1992 Yokomizo ..... 400/208

*Primary Examiner*—Ren Yan
*Assistant Examiner*—Lynn D. Hendrickson
*Attorney, Agent, or Firm*—Ronald P. Kananen

[57] ABSTRACT

An ink ribbon cartridge including a cartridge housing having a first side wall and a second side wall opposed to each other. The cartridge housing has a pair of first engaging portions on an inside surface of the first side wall. A supply spool and a take-up spool are rotatably disposed between the first and second side walls in spaced relation and carry an ink ribbon wound thereon. The spools have first end portions formed with flanges and second end portions opposed to the first end portions. The flanges have second engaging portions engageable with the first engaging portions. U-shaped leaf springs are disposed between the second side wall and the second end portions of the spools and bias the first end portions of the spools against the first side wall. The U-shaped leaf springs include base portions and annular portions extending from the base portions, respectively. The base portions have openings receiving the second end portions of the spools, respectively.

11 Claims, 18 Drawing Sheets

INK RIBBON CARTRIDGE

BACKGROUND OF THE INVENTION

The present invention relates to an ink ribbon cartridge for use in a color printer, specifically in a color printer of a sublimating and thermal transfer type.

Ink ribbon cartridges for a color printer are well known in the art. Generally, the ink ribbon cartridge includes a supply spool and a take-up spool rotatably disposed in a cartridge housing. The spools carry an ink ribbon connected at its both ends with the spools and wound thereon. The ink ribbon has a plurality of color regions arranged in series. Each of the color regions includes color segments, for example, yellow, magenta, cyan, and the like. The cartridge housing, the spools, and the ink ribbon are made of different kinds of synthetic resin such as HIPS (high impact polystyrene), PET (polyethylene terephthalate), or the like. A metal coil spring is interposed between a wall of the cartridge housing and one end of each of the spools and biases the spool against the wall.

Related Japanese Patent Applications No. P05-015037 and No. P05-195046 have been filed but unpublished.

Upon installation of the spool in the prior art ink ribbon cartridge, the coil spring mounted on the end of the spool must be installed in a compressed state on the corresponding wall of the cartridge housing. This installation work is neither easy nor convenient.

In addition, the prior art ink ribbon cartridge is generally of a disposable type. When the ink ribbon cartridge is disposed of, the metal coil spring must be separated from the cartridge housing made of synthetic resin. Similarly, the ink ribbon, the cartridge housing, and the spools, which are made of different kinds of synthetic resin from each other, must be separated upon melting for reuse. For instance, specifically in the case of the cartridge housing and spools made of HIPS, great heat energy of 15,000 kcal/kg is generated when they are melted in an incinerator. This great heat generation leads to a damage to the incinerator.

SUMMARY OF THE INVENTION

An object of the present invention is to provide an ink ribbon cartridge capable of readily installing spools in a cartridge housing.

Another object of the present invention is to provide an ink ribbon cartridge adapted for easy disposal for reuse.

According to one aspect of the present invention, there is provided an ink ribbon cartridge comprising:

a cartridge housing including a first wall and a second wall opposed to each other, the cartridge housing having a pair of first engaging portions on an inside surface of the first wall;

a pair of spools rotatably disposed between the first and second walls in spaced relation, the pair of spools including a supply spool and a take-up spool which carry an ink ribbon, the pair of spools having first end portions formed with flanges and second end portions opposed to the first end portions, the flanges having second engaging portions engageable with the pair of first engaging portions; and a pair of U-shaped leaf springs disposed between the second wall of the cartridge housing and the second end portions of the pair of spools to bias the first end portions o the pair of spools against the inside surface of the first wall;

the pair of U-shaped leaf springs including first base portions and second portions extending from the base portions, respectively, the base portions having openings which receive the second end portions of the pair of spools, respectively.

DESCRIPTION OF THE PREFERRED EMBODIMENT

Figure 1:
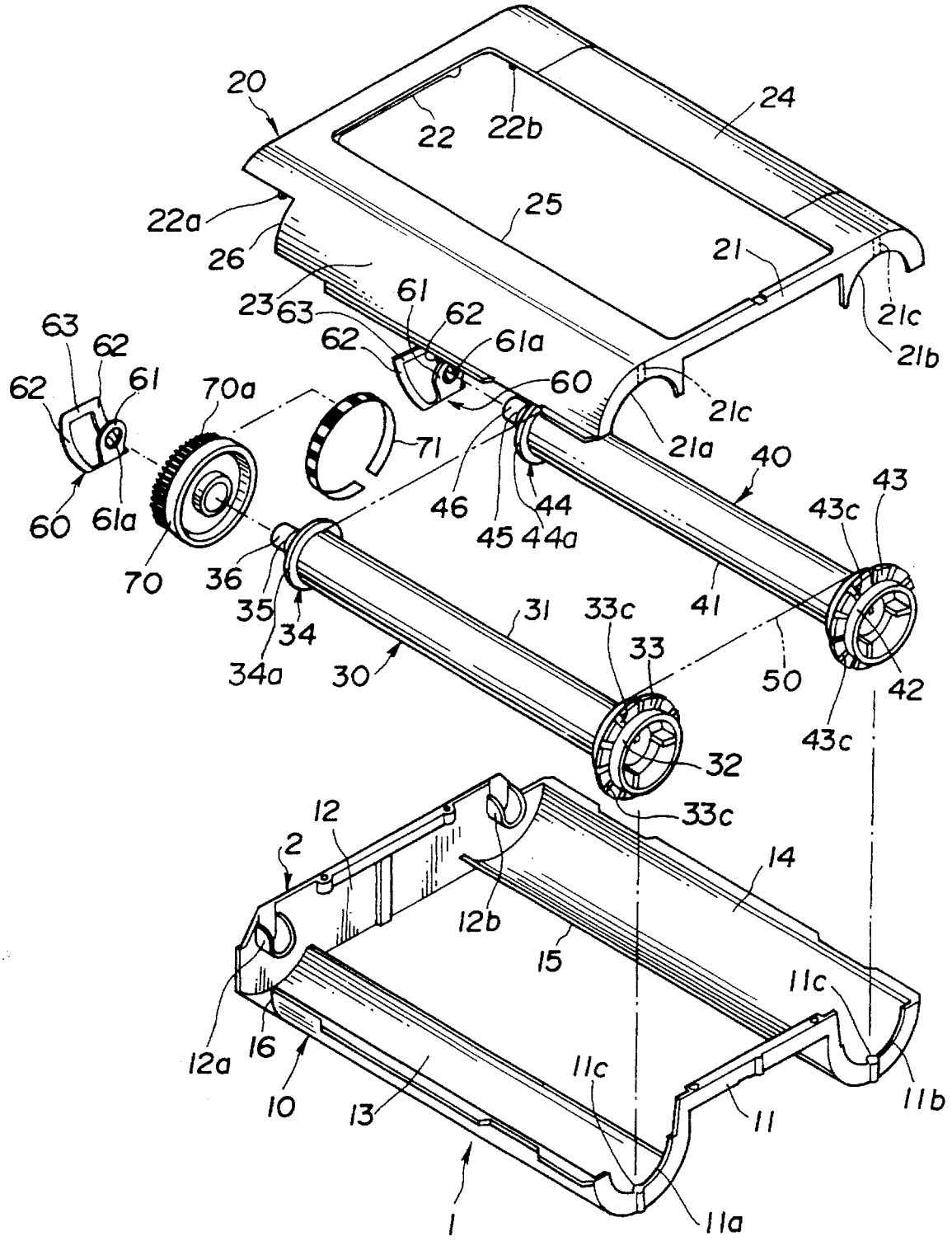
FIG. 1 is an exploded perspective view of a first embodiment of an ink ribbon cartridge according to the present invention.

Referring now to FIG. 1, there is shown an ink ribbon cartridge 1 for use in a color printer of a sublimating and thermal transfer type. As shown in FIG. 1, the ink ribbon cartridge 1 comprises a cartridge housing 2 including a lower shell 10 and an upper shell 20 which are both made of synthetic resin. The lower and upper shells 10 and 20 cooperate to form a unitary body in which a supply spool 30 and a take-up spool 40 are accommodated.

As shown in FIG. 1, the lower shell 10 is integrally formed with a pair of opposed first and second side walls 11 and 12 and a pair of opposed arch-like curved walls 13 and 14. The opposed arch-like curved walls 13 and 14 are formed of a generally semicylindrical shape opening upwardly as viewed in FIG. 1. These walls 11 to 14 cooperate to define an opening 15 through which a thermal head of the printer is introduced into the cartridge housing 2.

Similarly, s shown in FIG. 1, the upper shell 20 is integrally formed with a pair of opposed side walls 21 and 22 and a pair of opposed arch-like curved walls 23 and 24. The opposed arch-like curved walls 23 and 24 are formed of a generally semi-cylindrical shape opening downwardly as viewed in FIG. 1. As shown in FIG. 1, the opposed curved walls 23 and 24 face the corresponding curved walls 13 and 14, respectively, to define spool receptacle sections in cooperation with the arch-like curved walls 13 and 14 of the lower shell 10. An opening 25 is defined by these walls 21 to 24 in an opposed relation to the opening 15 of the lower shell 10.

The supply spool 30 and the take-up spool 40 are rotatably disposed in the spool receptacle sections defined by the lower and upper shells 10 and 20. The supply and take-up spools 30 and 40 are made of synthetic resin. An ink ribbon 50 is wound around the supply spool 30 at one end thereof and the take-up spool 40 at the other end thereof. The ink ribbon 50 has a plurality of color blocks arranged in series. Each of the color blocks includes segments of yellow, magenta, and cyan.

Figure 11:
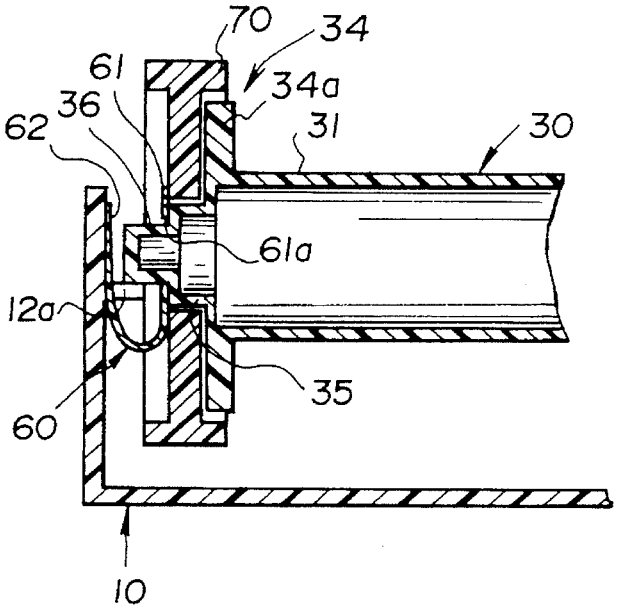
FIG. 11 is a sectional view showing a supply spool with the leaf spring which is installed in a lower shell of the cartridge housing.

As shown in FIG. 1, the supply spool 30 includes a cylindrical body 31, and a first end portion 32 and a second end portion 34 which are disposed at opposite ends of the cylindrical body 31. The first end portion 32 has a larger diameter than that of the body 31. As seen in FIG. 1, an annular flange 33 is formed on the first end portion 32 and has a plurality of radial grooves 33*c* on one end face thereof. The second end portion 34 is integrally formed with an annular flange 34*a*. The second end portion 34 includes a middle-diameter section 35 having a smaller diameter than that of the first end portion 32, and a small-diameter section 36 having a smaller diameter than that of the middle-diameter section 35. The middle-diameter section 35 and the small-diameter section 36 cooperate to form a shoulder portion therebetween as best shown in FIG. 11. Fit on the middle-diameter section 35 is a code ring 70 having a circumferential outer surface. The circumferential outer surface is formed with a gear section 70*a* on a half area thereof and carries a bar code label 71 attached onto the remaining half area thereof. The bar code label 71 includes such information as kind, size, thermal sensitivity, and the like of the ink ribbon 50. The code ring 70 is partly exposed from notches 16 and 26 which are formed on the curved walls 13 and 23 of the lower and upper shells 10 and 20, respectively.

The take-up spool 40 has a structure similar to that of the supply spool 30 as seen in FIG. 1. Numerals 41, 42, 43, 43*c*, 44, 44*a*, 45, and 46 denote a cylindrical body, a first end portion, an annular flange, radial grooves, a second end portion, an annular flange, a middle-diameter section, and a small-diameter section, respectively, which correspond to those for the supply spool 30 and therefore the detailed explanations are omitted.

As shown in FIG. 1, the first side wall 11 of the lower shell 10 is integrally formed with a pair of semicircular bearing portions 11*a* and 11*b* and a pair of projections 11*c* projecting radially inward from the semicircular bearing portions 11*a* and 11*b*. The bearing portions 11*a* and 11*b* are opposed to a pair of semicircular bearing portions 21*a* and 21*b* formed on the first side wall 21 of the upper shell 20. Similarly, the projections 11*c* are opposed to a pair of projections 21*c* extending radially downward as viewed in FIG. 1, from the bearing portions 21*a* and 21*b*. The bearing portions 11*a*, 11*b* and 21*a*, 21*b* cooperate to form a pair of circular bearings so as to support the first end portions 32 and 42 of the supply and take-up spools 30 and 40. The projections 11*c* and 21*c* are engaged with and disengaged from the radial grooves 33*c* and 43*c* of the flanges 33 and 43 during rotation of the supply and take-up spools 30 and 40.

As seen in FIG. 1, the second side wall 12 of the lower shell 10 is integrally formed on an inside surface thereof with a pair of bearing portions 12*a* and 12*b* having a generally U shape section. The bearing portions 12*a* and 12*b* support the small-diameter sections 36 and 46 of the second end portions 34 and 44 of the supply and take-up spools 30 and 40. The bearing portions 12*a* and 12*b* are opposed to a pair of ribs 22*a* and 22*b* extending downward as viewed in FIG. 1, from an inside surface of the upper shell 20. The ribs 22*a* and 22*b* restrict vertical displacement of the small-diameter sections 36 and 46 when the second end portions 34 and 44 of the supply and take-up spools 30 and 40 are placed on the respective bearing portions 12*a* and 12*b*.

A pair of U-shaped leaf springs 60, 60 as shown in FIG. 1 are disposed between the second side wall 12 and the second end portions 34 and 44 of the supply and take-up spools 30 and 40. Each of the leaf springs 60 is made of synthetic resin, preferably POM (polyoxymethylene), PBT (polybutylene terephthalate), or the like.

Figure 2:
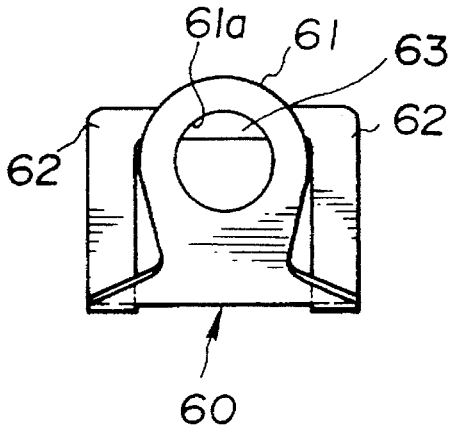
FIGS. 2 to 4 are front, side and rear views of a leaf spring used in the ink ribbon cartridge, respectively.
Figure 3:
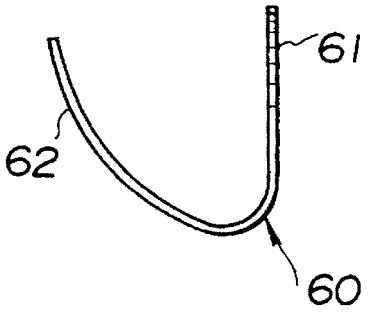
Figure 4:
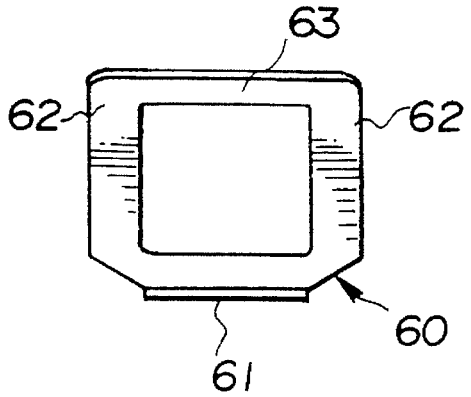

As best shown in FIGS. 2 to 4, each of the leaf springs 60 includes a circular base portion 61 and a rectangular or annular second portion extending from the base portion 61. The base portion 61 has an opening 61*a* which has a larger diameter than that of the small-diameter sections 36 and 46 of the supply and take-up spools 30 and 40 and receives each of the small-diameter sections 36 and 46 with play. As best shown in FIG. 4, the rectangular second portion of the leaf spring 60 includes two opposed legs 62, 62 extending from the base portion 61, and a connecting portion 63 joining ends of the legs 62, 62.

An assembly operation of the ink ribbon cartridge will now be described.

Figure 5:
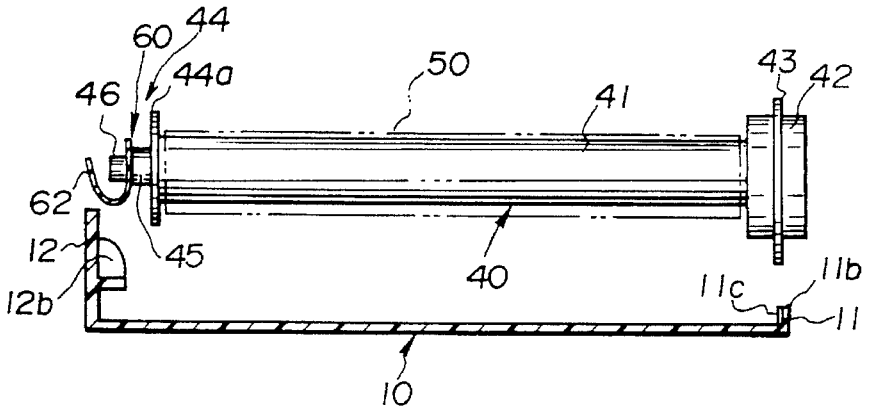
FIGS. 5 to 7 are sectional views showing installing operations of a take-up spool into a cartridge housing.
Figure 6:
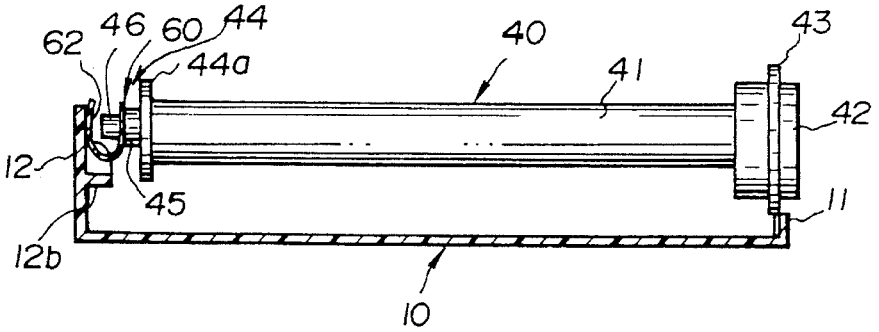
Figure 7:
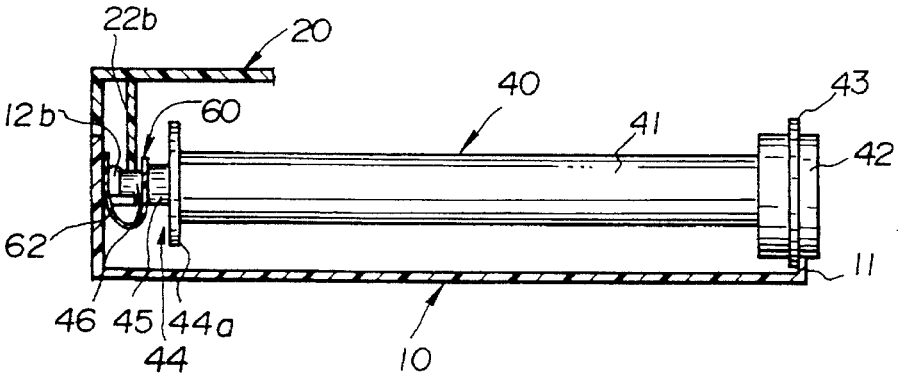
Figure 8:
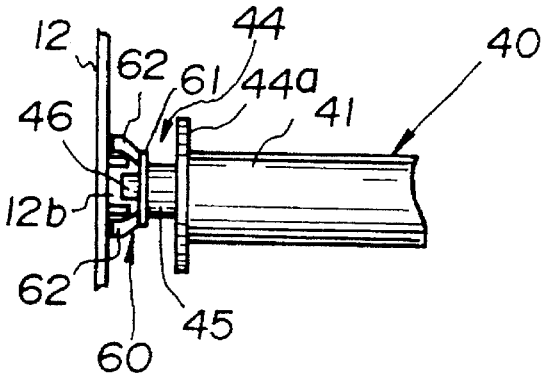
FIG. 8 is a fragmentary plan view of FIG. 5.
Figure 9:
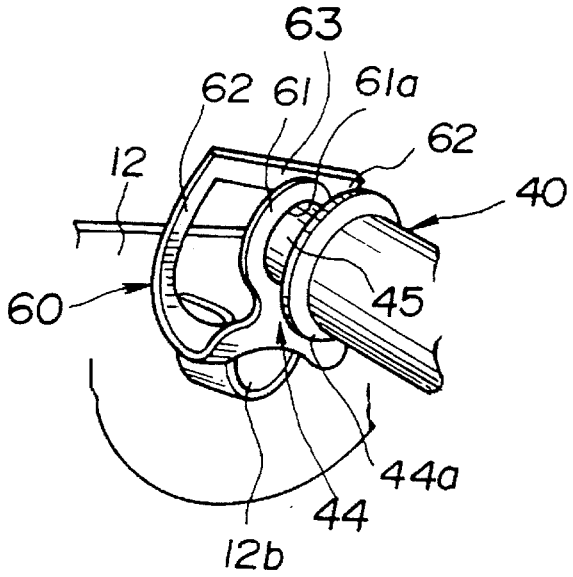
FIG. 9 is a fragmentary perspective view of FIG. 6.
Figure 10:
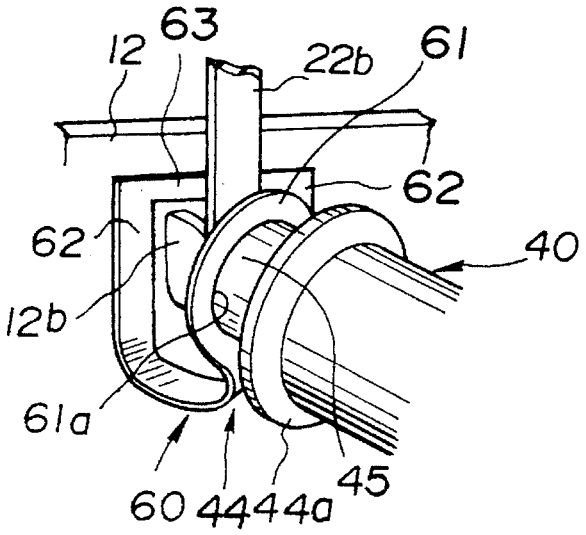
FIG. 10 is a fragmentary perspective view of FIG. 7.

First, the leaf springs 60 are mounted on the supply and take-up spools 30 and 40, respectively. As seen in FIGS. 5 and 8, when the leaf spring 60 is mounted on the second end portion 44 of the take-up spool 40, the small-diameter section 46 is inserted into the opening 61*a*. The base portion 61 of the leaf spring 60 contacts with a radially extending surface disposed between the middle-diameter section 45 and the small-diameter section 46. Subsequently, as seen in FIGS. 6 and 9, the small-diameter section 46 with the leaf spring 60 is depressed into the bearing portion 12*b* of the second side wall 12 while the rectangular second portion of the leaf spring 60 is kept being urged against the second side wall 12. Then, the small-diameter section 46 is engaged with the bearing portion 12*b*, as seen in FIG. 7. The rectangular second portion is allowed to contact the inside surface of the second side wall 12, as seen in FIG. 10. On the other hand, the first end portion 42 of the take-up spool 40 is engaged with the bearing portion 11*b* of the first side wall 11, as seen in FIG. 7. The leaf spring 60 biases the take-up spool 40 such that the first end portion 42 bears against the inside surfaces of the first side walls 11 and 21 of the lower and upper shells 10 and 20. Thus, the groove 43*c* of the flange 43 is engageable with the projection 11*c* of the bearing portion 11*b* such that the ink ribbon 50 is smoothly fed without any loosening around the take-up spool 40.

Mounting of the leaf spring 60 on the second end portion 34 of the supply spool 30 is carried out after the code ring 70 is fit on the middle-diameter section 35 of the supply spool 30. As shown in FIG. 11, when the small-diameter section 36 is inserted into the opening 61*a* of the leaf spring 60, the base portion 61 of the leaf spring 60 contacts both one end face of the code ring 70 and a radially extending surface of the shoulder portion between the middle-diameter section 35 and the small-diameter section 36. Thus, the code ring 70 is interposed between the base portion 61 of the leaf spring 60 and the flange 34*a* of the supply spool 30 to thereby be prevented from removal from the supply spool 30. After completing installation of both the take-up spool 40 and the supply spool 30 in the lower shell 10, the upper shell 20 is attached to the lower shell 10, as shown in FIG. 7.

As is appreciated from the above description, the provision of the leaf spring 60 serves for easy assembly of the supply and take-up spools 30 and 40 in the cartridge housing 2 without undesired looseness. In addition, owing to the simple configuration, the leaf spring 60 is readily manufactured and provides a stable biasing force applied to the supply and take-up spools 30 and 40.

Referring to FIGS. 12–23, there is shown a second embodiment of the ink ribbon cartridge according to the invention. The second embodiment differs from the aforementioned first embodiment in provision of modified leaf springs 160 and provision of recessed portions 12*c* and 12*d* on the second side wall 12 of the lower shell 10, in which like numerals denote like parts and therefore detailed descriptions thereabout are omitted.

Figure 12:
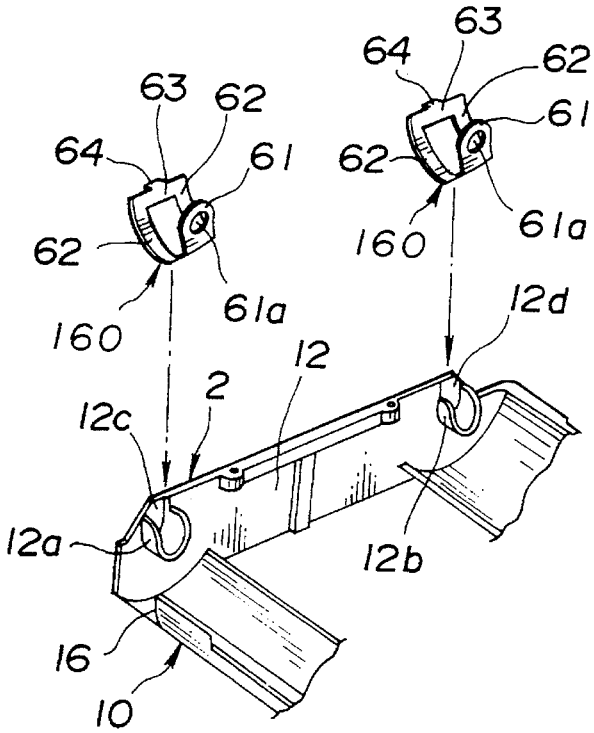
FIG. 12 is a perspective view of an essential part of a second embodiment.
Figure 13:
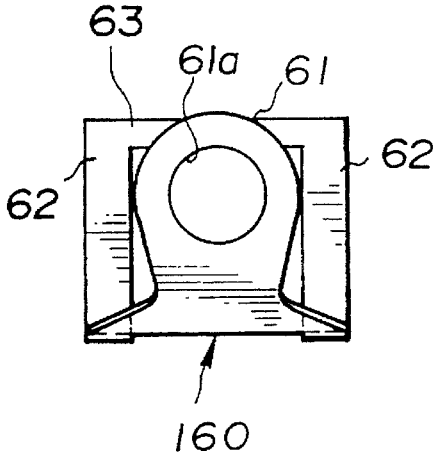
FIGS. 13 to 15 are front, side and rear views of a leaf spring used in the second embodiment, respectively.
Figure 14:
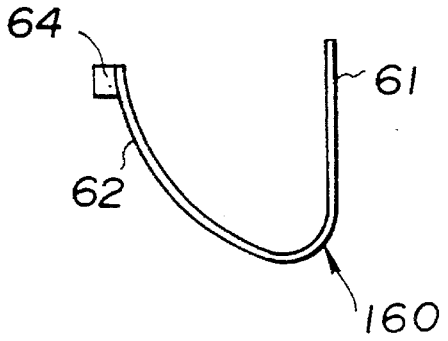
Figure 15:
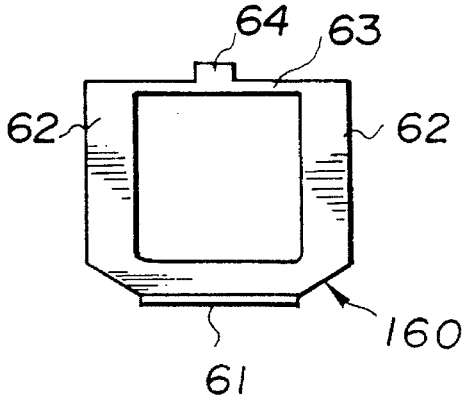
Figure 16:
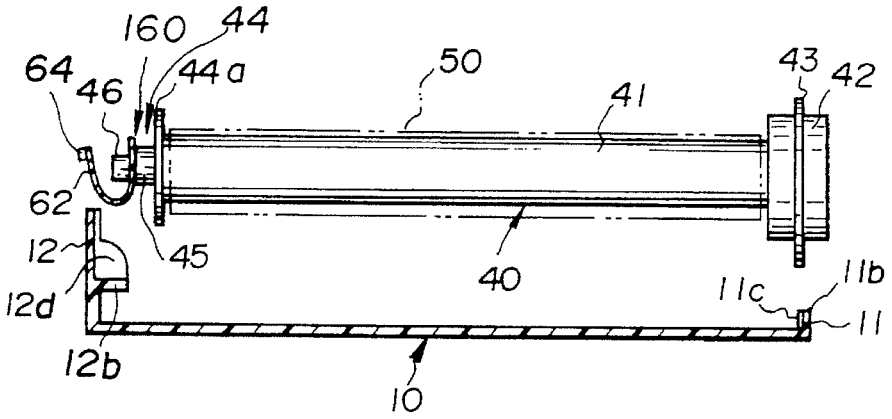
FIGS. 16 to 18 are sectional views showing installing operations of the take-up spool with the leaf spring into the cartridge housing in the second embodiment.
Figure 17:
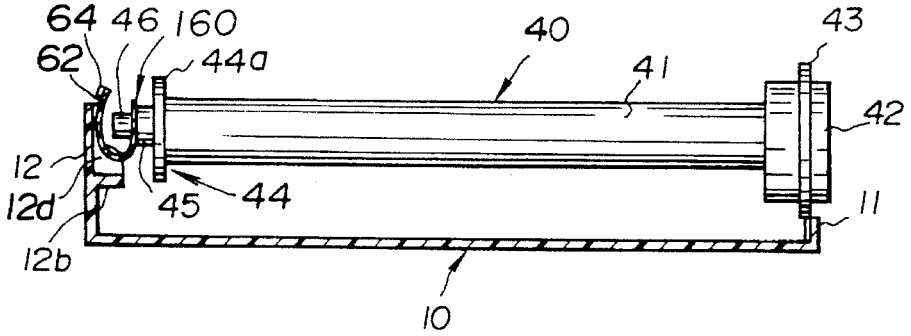
Figure 18:
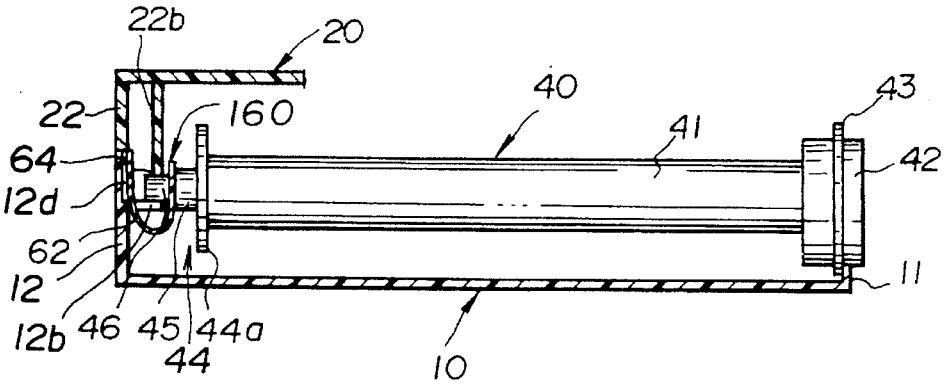
Figure 19:
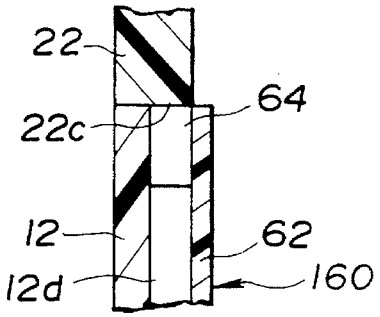
FIG. 19 is a fragmentary enlarged view of the leaf spring as shown in FIG. 18.
Figure 20:
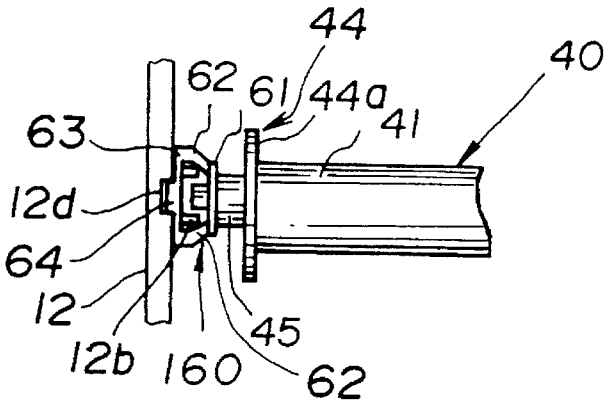
FIG. 20 is a fragmentary plan view of FIG. 16.
Figure 21:
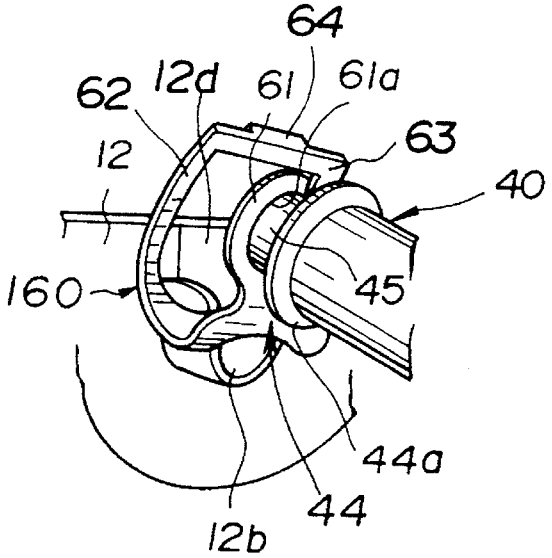
FIG. 21 is a fragmentary perspective view of FIG. 17.
Figure 22:
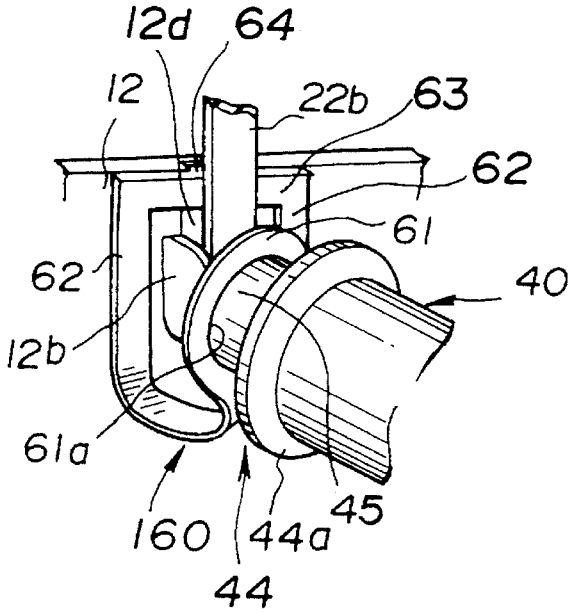
FIG. 22 is a fragmentary perspective view of FIG. 18.
Figure 23:
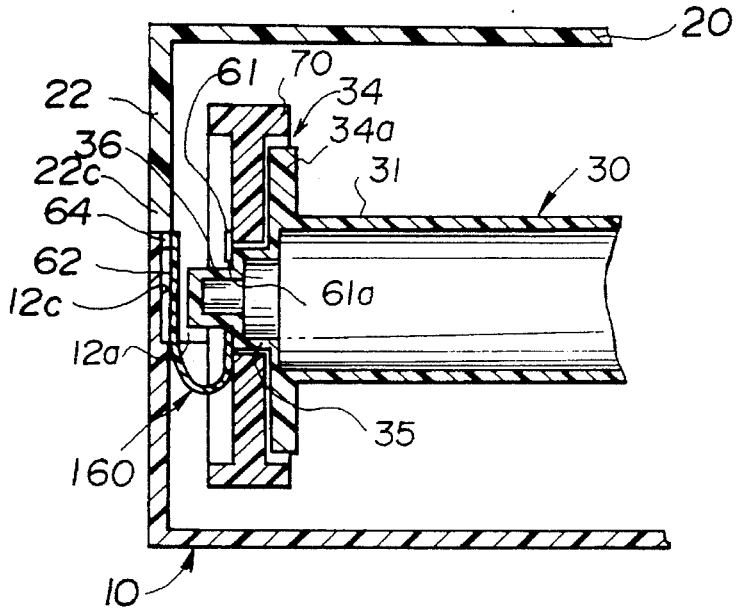
FIG. 23 is a sectional view of the supply spool with the leaf spring which is installed into the cartridge housing in the second embodiment.

As shown in FIGS. 12–15, each of the modified leaf springs 160 is of a generally U shape in section and similar to the leaf spring 60 of the first embodiment except formation of an integral engaging member 64. Therefore, like numerals indicate like parts. As best shown in FIGS. 14 and 15, the integral engaging member 64 is of a square shape and projects outward from the connecting portion 63 joining ends of the legs 62, 62. Upon installation of the supply and take-up spools 30 and 40 with the leaf springs 160, the integral engaging members 64 are engaged with the recessed portions 12*c* and 12*d* of the inside surface of the second side wall 12, as best shown in FIG. 19. The recessed portions 12*c* and 12*d* are disposed in areas which are surrounded with the bearing portions 12*a* and 12*b* as seen in FIG. 12. The integral engaging members 64 also contact an end edge 22*c* of the second side wall 22 of the upper shell 20 so that the leaf spring 160 is prevented from vertical displacement. The provision of the integral engaging members 64 and recessed portions 12*c* and 12*d* engageable therewith serves for holding the leaf springs 160 in place to thereby surely bias the supply and take-up spools 30 and 40.

Further, as compared with the coil spring used in the prior art ink ribbon cartridge, the leaf spring 160 with the integral engaging member 64 may apply a suitable biassing force to the supply and take-up spools 30 and 40 when the ink ribbon cartridge 1 is installed in the printer (not shown). Therefore, the supply and take-up spools 30 and 40 are surely rotated to thereby smoothly feed the ink ribbon 50 without any loosening.

Figure 24:
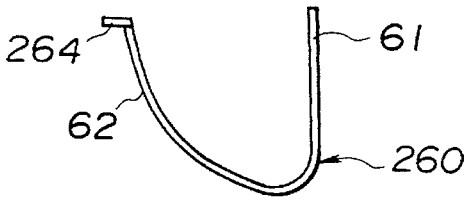
FIG. 24 is a side view of a leaf spring used in a third embodiment.
Figure 25:
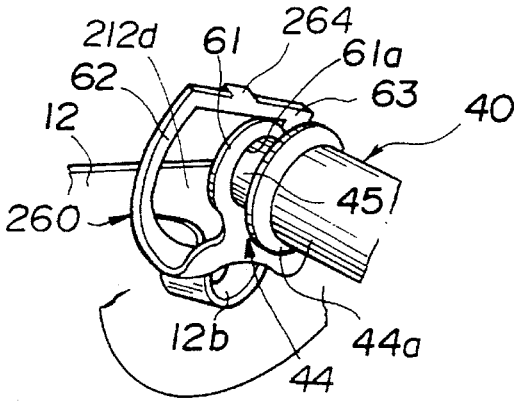
FIG. 25 is a perspective view of the leaf spring of FIG. 24.
Figure 26:
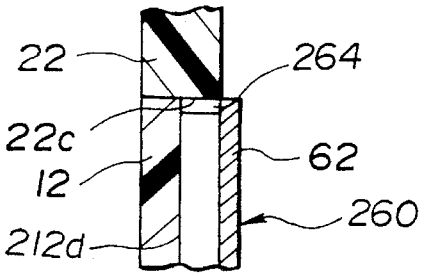
FIG. 26 is a fragmentary enlarged section of the leaf spring of FIG. 24.

Referring to FIGS. 24–26, there is shown a third embodiment of the ink ribbon cartridge according to the present invention. The third embodiment differs from the aforementioned first embodiment in provision of modified leaf springs 260 and recessed portions 12*c* and 12*d* engageable with the leaf springs 260. Like numerals denote like parts and therefore detailed descriptions thereabout are omitted. The leaf spring 260 is made of metal. As shown in FIGS. 24–26, the leaf spring 260 is integrally formed with a tab portion 264. The tab portion 264 extends laterally outward from the connecting portion 63 to be received in each of the recessed portions 12*c* and 12*d* of the second side wall 12 of the lower shell 10. The recessed portions 12*c* and 12*d* are disposed in areas of an inside surface of the second side wall 12 which are surrounded with the bearing portions 12*a* and 12*b*. The tab portion 264 engages the lower end edge 22*c* as viewed in FIG. 26, of the second side wall 22 of the upper shell 20. The leaf spring 260 with the tab portion 264 ensures to apply a suitable biasing force to the supply and take-up spools 30 and 40 as well as the leaf spring 60 of the aforementioned first embodiment.

Figure 27:
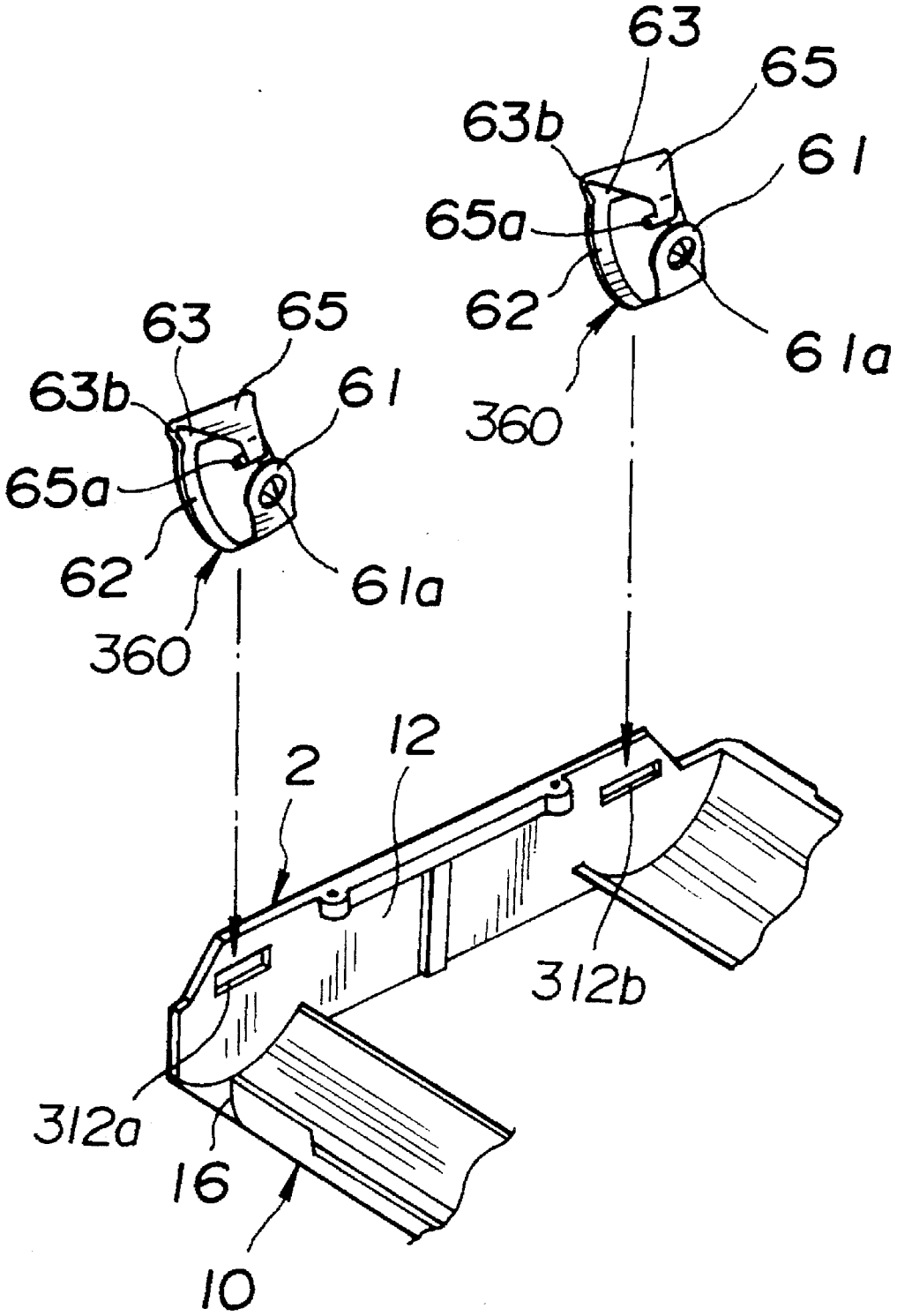
FIG. 27 is a perspective view showing an essential part of a fourth embodiment.
Figure 28:
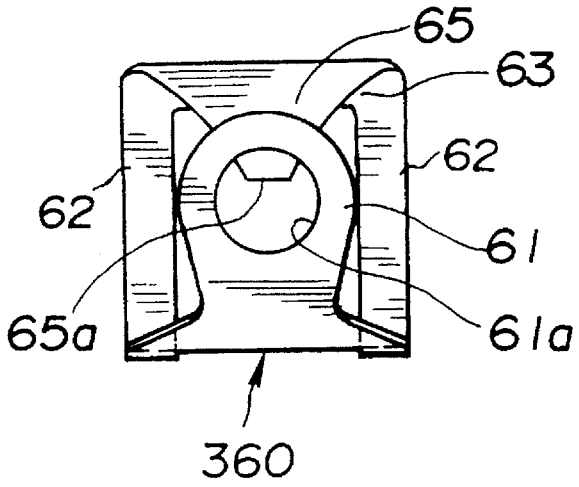
FIGS. 28 to 30 are front, side and rear views of a leaf spring used in the fourth embodiment, respectively.
Figure 29:
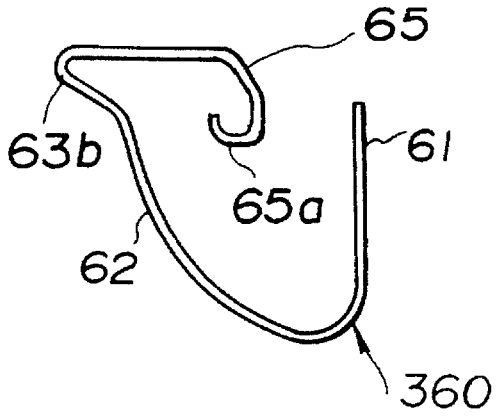
Figure 30:
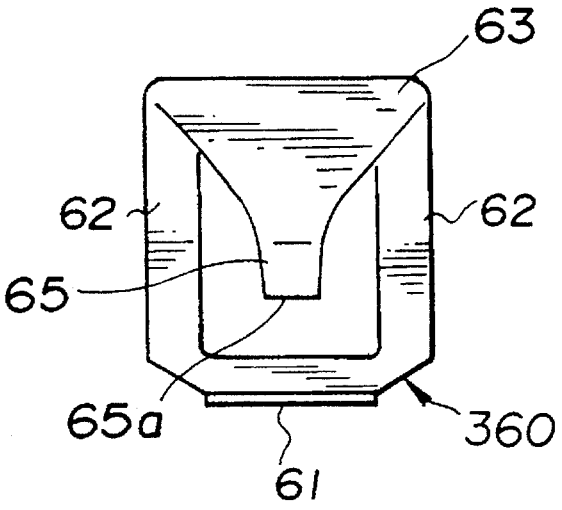
Figure 31:
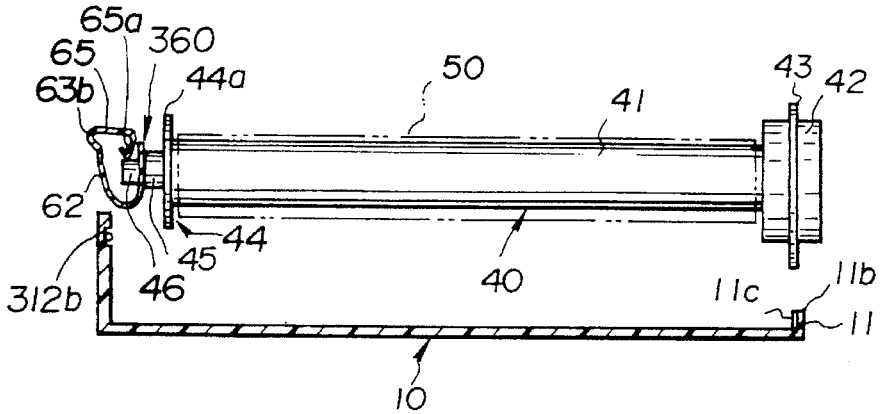
FIGS. 31 to 33 are sectional views showing installing operations of the take-up spool with the leaf spring into the cartridge housing in the fourth embodiment.
Figure 32:
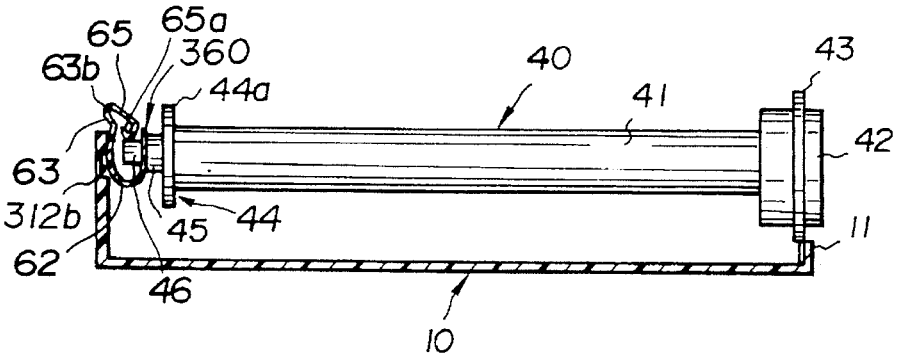
Figure 33:
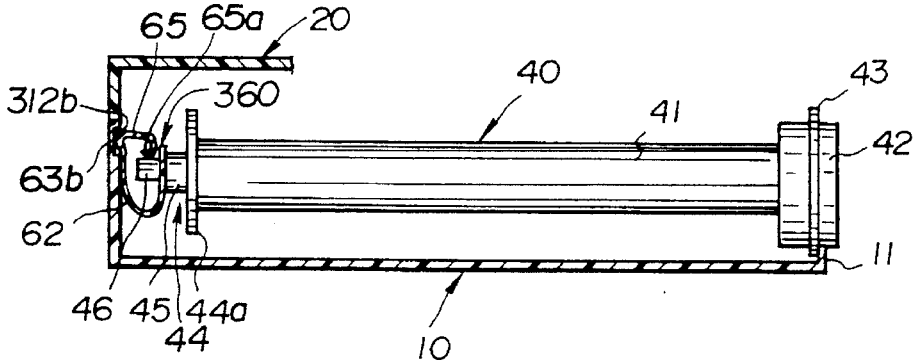
Figure 34:
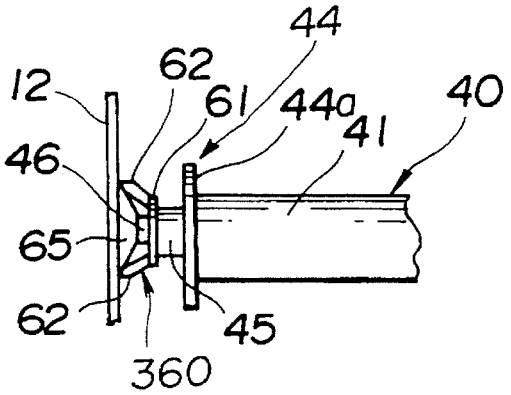
FIG. 34 is a fragmentary plan view of FIG. 31.
Figure 35:
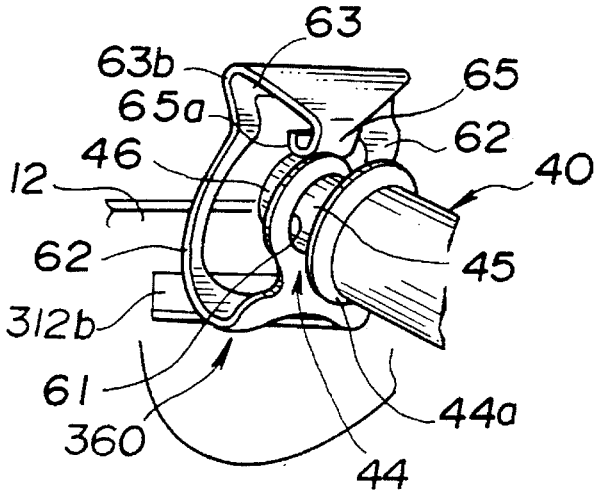
FIG. 35 is a fragmentary perspective view of FIG. 32.
Figure 36:
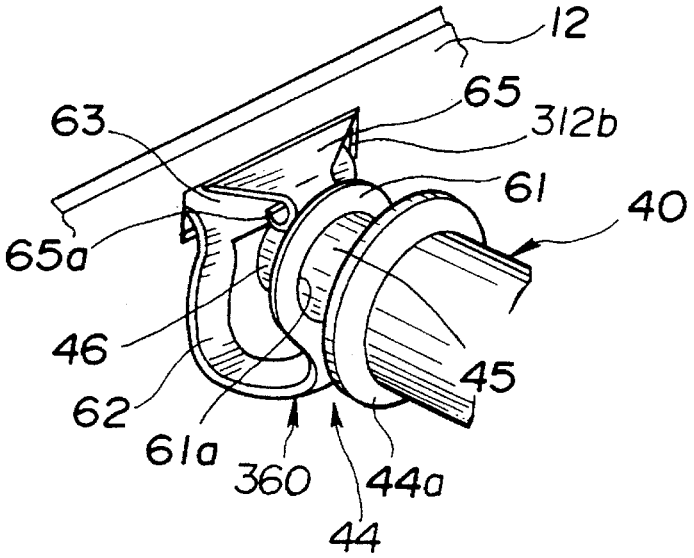
FIG. 36 is a fragmentary perspective view of FIG. 33.
Figure 37:
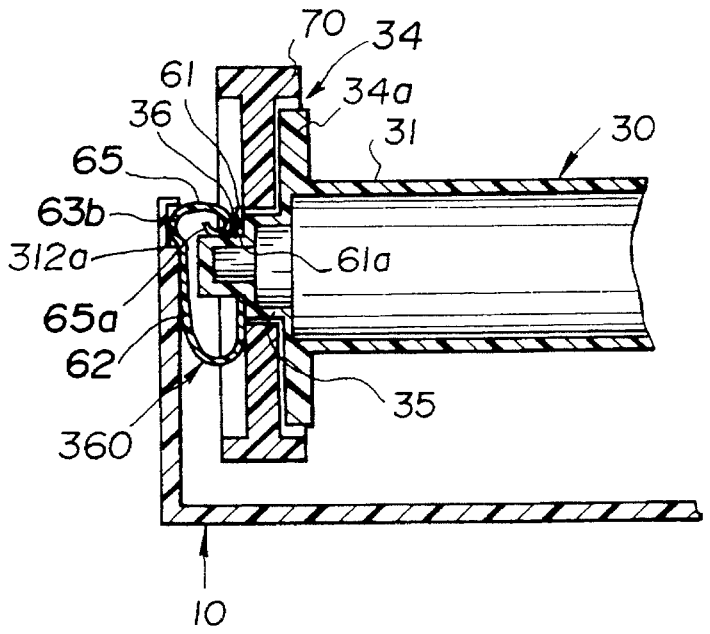
FIG. 37 is a sectional view showing the supply spool with the leaf spring which is installed in the lower shell in the fourth embodiment.

Referring to FIGS. 27–37, there is shown a fourth embodiment of the ink ribbon cartridge according to the present invention. As best shown in FIG. 27, the fourth embodiment differs from the aforementioned first embodiment in provision of modified leaf springs 360 and recessed portions 312*a* and 312*b* engageable with the leaf springs 360. Like numerals denote like parts and therefore detailed descriptions thereabout are omitted. The leaf spring 360 is made of synthetic resin. As best shown in FIGS. 29 and 30, the leaf spring 360 is of a generally U shape in section and formed with a protrudent engaging portion 63*b* extending outward from the connecting portion 63, a triangular portion 65 extending from the protrudent engaging portion 63*b* toward the base portion 61, and a curved distal end 65*a* extending from the triangular portion 65. The recessed portions 312*a* and 312*b* are so arranged in a predetermined area of an inside surface of the second side wall 12 of the lower shell 10 as to be opposed to the protrudent engaging portions 63*b* and receive those in fitting relation when the supply and take-up spools 30 and 40 with the leaf springs 360 are installed in the lower shell 10. FIGS. 31–33 show the protrudent engaging portion 63*b* fit in the recessed portion 312*b* when the take-up spool 40 with the leaf spring 360 is installed in the lower shell 10. When the leaf spring 360 is mounted on the take-up spool 40 as seen in FIG. 31, the curved distal end 65*a* biases the small-diameter section 46 to keep the small-diameter section 46 received in the opening 61*a* of the base portion 61. The curved distal end 65*a* serves for preventing the take-up spool 40 from upward displacement as viewed in FIG. 31. The take-up spool 40 is prevented from downward displacement by the engagement of the small-diameter section 46 with the opening 61*a* of the base portion 61 of the leaf spring 380. Similarly, when the leaf spring 860 is mounted on the supply spool 30, the curved distal end 65*a* biases the small-diameter section 36 of the supply spool 30 and prevents the take-up spool 40 from upward displacement. The supply spool 30 is also prevented from downward displacement by the engagement of the small-diameter section 36 with the opening 61*a* of the base portion 61 of the leaf spring 360. The leaf spring 360 ensures to apply a suitable biasing force to the supply and take-up spools 30 and 40 as well as the leaf spring 60 of the aforementioned first embodiment.

Figure 38:
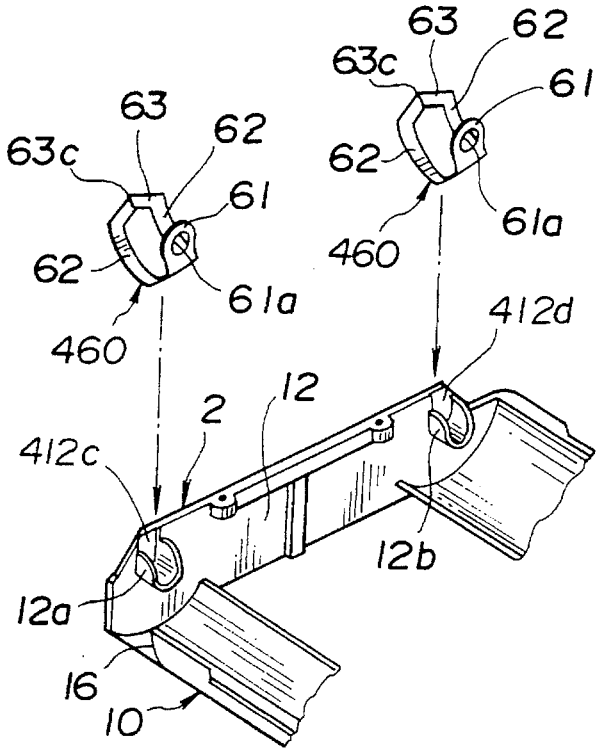
FIG. 38 is a perspective view showing an essential part of a fifth embodiment.
Figure 39:
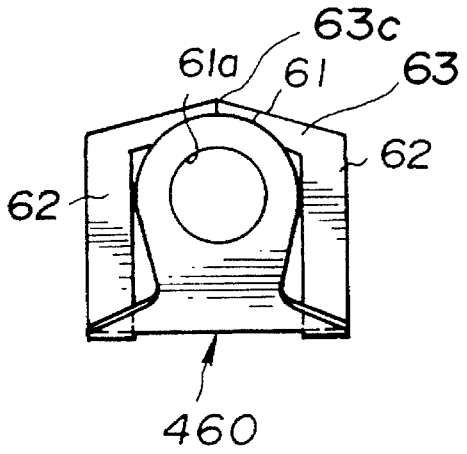
FIGS. 39 to 41 are front, side and rear views of a leaf spring aced in the fifth embodiment, respectively.
Figure 40:
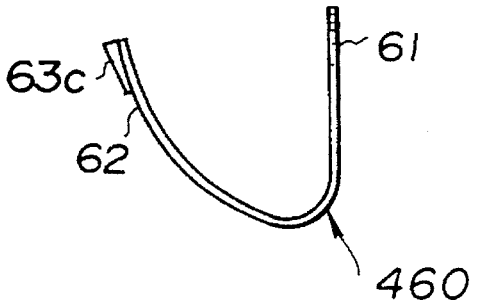
Figure 41:
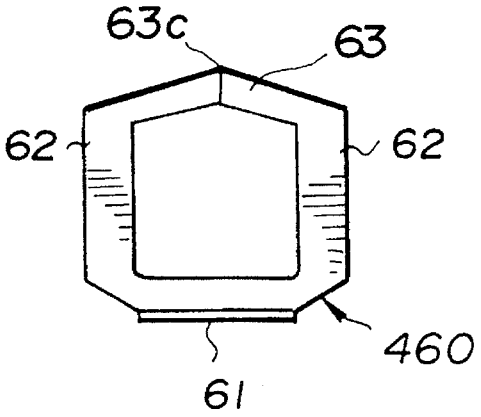
Figure 42:
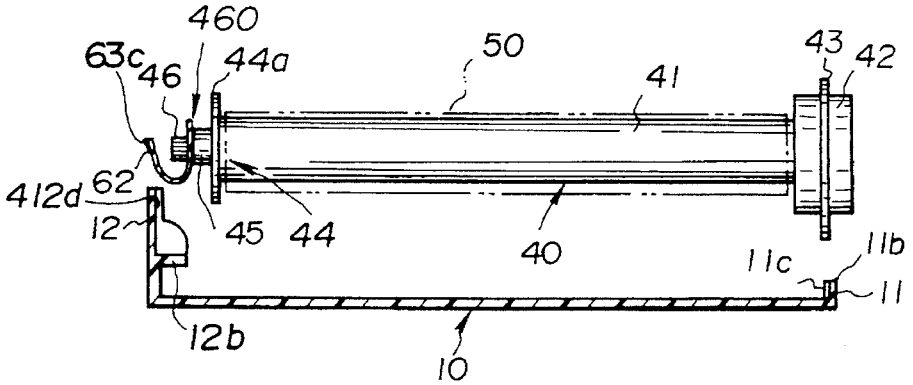
FIGS. 42 to 44 are sectional views showing installing operations of the take-up spool with the leaf spring into the cartridge housing in the fifth embodiment.
Figure 43:
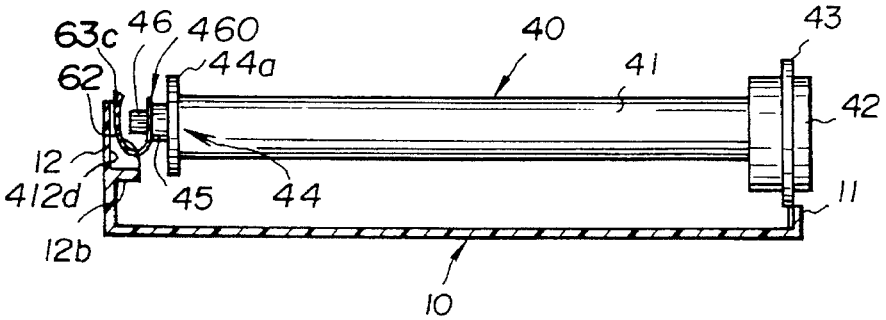
Figure 44:
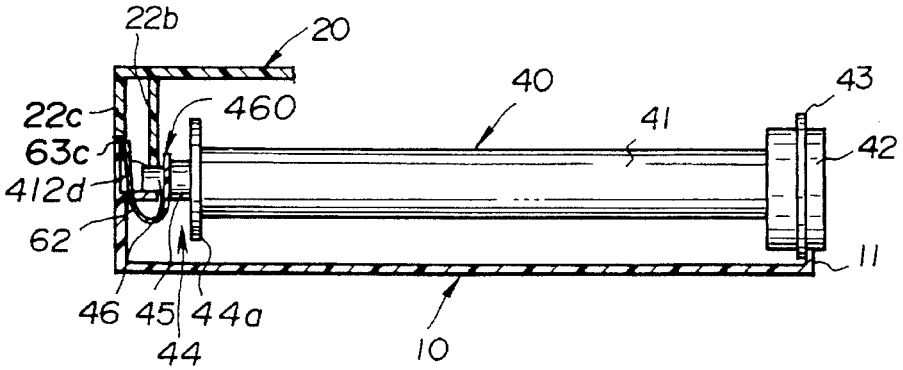
Figure 45:
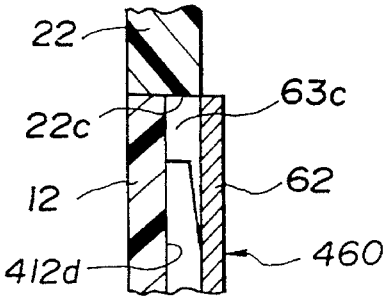
FIG. 45 is a fragmentary enlarged section of FIG. 44.
Figure 46:
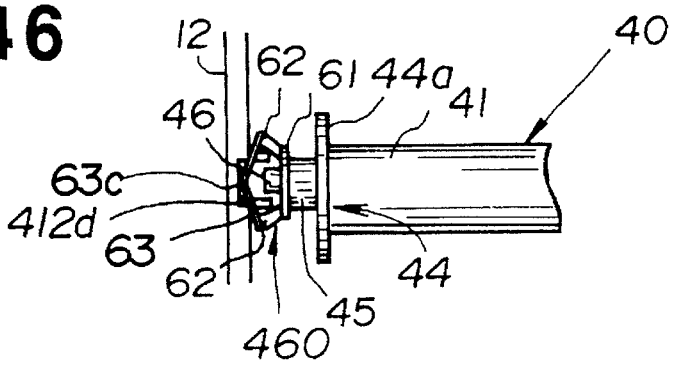
FIG. 46 is a fragmentary plan view of FIG. 42.
Figure 47:
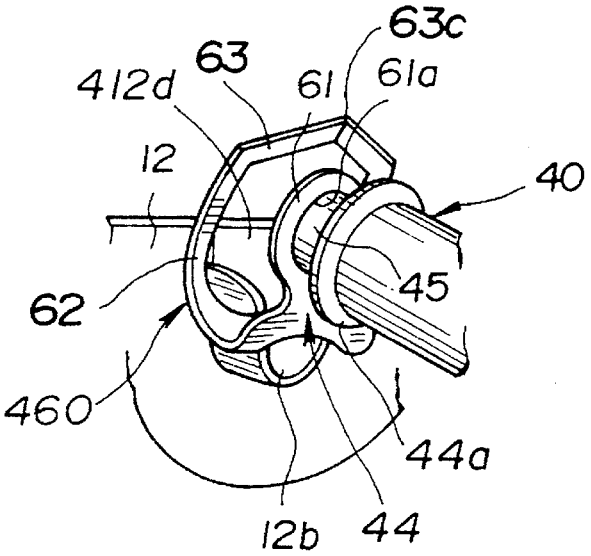
FIG. 47 is a fragmentary perspective view of FIG. 43.
Figure 48:
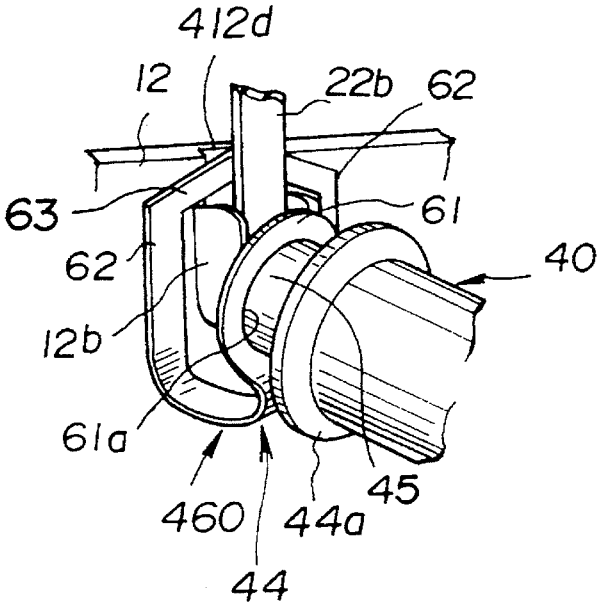
FIG. 48 is a fragmentary perspective view of FIG. 44.
Figure 49:
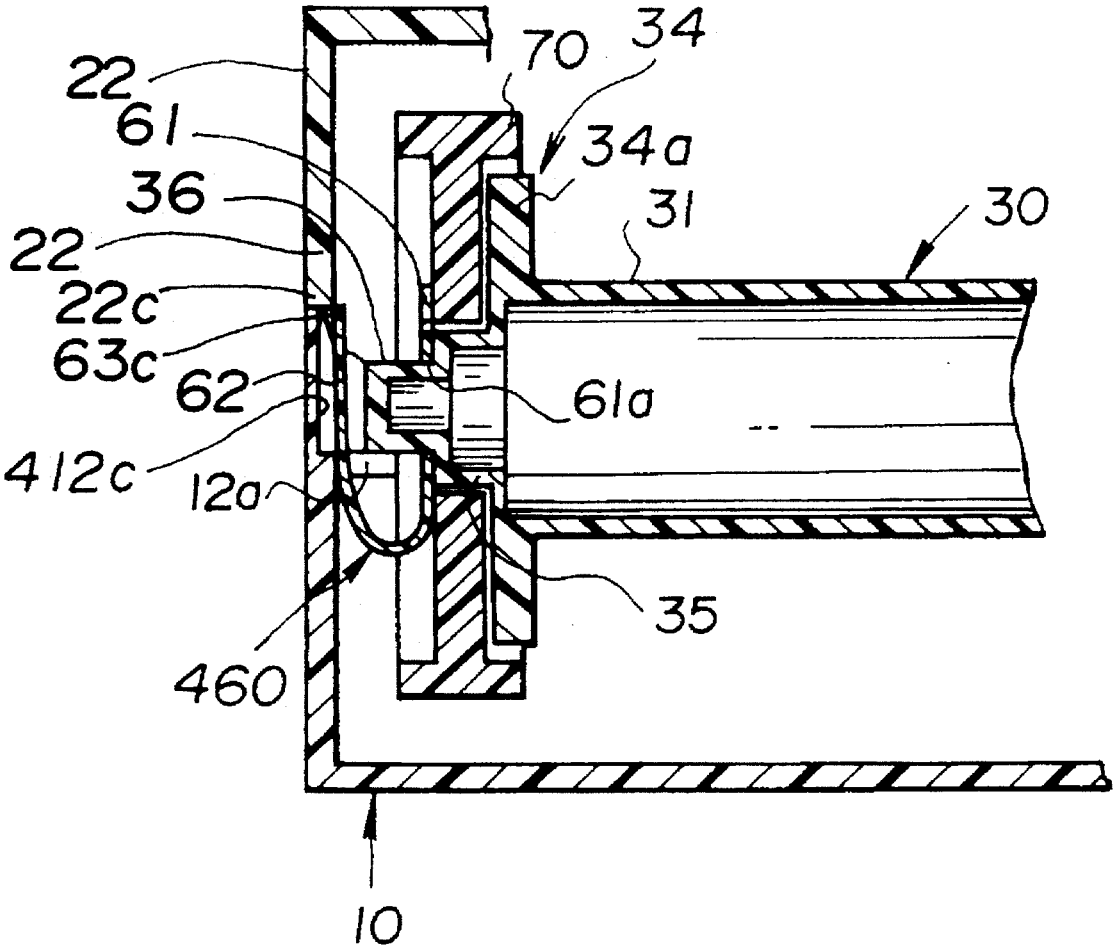
FIG. 49 is a sectional view showing the supply spool with the leaf spring which is installed in the cartridge housing in the fifth embodiment.

Referring to FIGS. 38–49, there is shown a fifth embodiment of the ink ribbon cartridge according to the present invention. As best shown in FIG. 38, the fifth embodiment differs from the aforementioned first embodiment in provision of modified leaf springs 460 and recessed portions 412*c* and 412*d* engageable with the leaf springs 460. Like numerals denote like parts and therefore detailed descriptions thereabout are omitted. The leaf spring 460 is made of metal. As shown in FIGS. 38–41, the leaf spring 460 is of a generally U shape in section and integrally formed with a generally reverse V-shaped engaging portion 63*c*. The reverse V-shaped engaging portion 63*c* is formed on a mid-portion of the connecting portion 63 as best shown in FIG. 41, and engaged with the recessed portions 412*c* and 412*d* which are formed on an inside surface of the second side wall 12 of the lower shell 10 as seen in FIG. 38. The recessed portions 412*c* and 412*d* are disposed in areas which are surrounded with the bearing portions 12*a* and 12*b* of the second side wall 12. The reverse V-shaped engaging portions 63*c* are received in the recessed portions 412*c* and 412*d* as shown in FIGS. 46 and 49. The reverse V-shaped engaging portions 63*c* are also engaged with the lower end edge 22*c* as viewed in FIG. 49, of the second side wall 22 of the upper shell 20 and prevent a vertical displacement of the leaf spring 460 upon assembly. Thus, the leaf spring 460 ensures to apply a suitable biasing force to the supply and take-up spools 30 and 40 as well as the leaf spring 60 of the aforementioned first embodiment.

The ink ribbon cartridge of disposable type may comprise a cartridge housing 2, supply and take-up spools 30 and 40, an ink ribbon 50, and a code ring 70, all of which are made of PET. Specifically, the lower and upper shells 10 and 20, the spools 30 and 40, and the code ring 70 may be made of amorphous PET and produced by an injection molding method. Conventionally, amorphous PET has not been generally utilized as a molding material because it is not readily molded due to its relatively low crystallizability, melt viscosity and hydrolytic property. Recently, it has been found that a crystallization of amorphous PET is well controlled by a modification of the polymer so that the resultant copolymer exhibits a good moldability. The resultant copolymer has extremely low crystallization rate and is of thermoplastic polyester which is always present in an amorphous state without any change in density. The ink ribbon 50 may be made of a biaxially oriented film made of PET.

The disposable type ink ribbon cartridge including the ink ribbon 50, the cartridge housing 2, the supply and take-up spools 30 and 40, and a code ring 70, all of which are made of PET, can be melted for reuse without separation of the components. In addition, when the PET components of the used ink ribbon cartridge is disposed of in an incinerator, heat energy of approximately 5,000 kcal/kg is generated which is close to heat energy of approximately 4,500 kcal/kg generated in burning paper. The generation of the relatively low heat does not cause damages to the incinerator. The ink ribbon cartridge consisting of the PET components can be readily disposed of in the incinerator without causing damages to the incinerator due to the heat generation.

The ink ribbon cartridge of the present invention may be applied to a color printer of a melting and thermal transfer type.

What is claimed is:

1. An ink ribbon cartridge comprising:

a cartridge housing including a first wall and a second wall opposed to each other, said cartridge housing having a pair of first engaging portions on an inside surface of said first wall;

a pair of spools rotatably disposed between said first and second walls in spaced relation, said pair of spools including a supply spool and a take-up spool which carry an ink ribbon, said pair of spools having first end portions formed with flanges and second end portions opposed to said first end portions engageable with said pair of first engaging portions; and a pair of U-shaped leaf springs disposed between said second wall of said cartridge housing and said second end portions of said pair of spools to bias said first end portions of said pair of spools against said inside surface of said first wall;

said pair of U-shaped leaf springs including first base portions and second portions extending from said base portions, respectively, said base portions having openings which receive said second end portions of said pair of spools, respectively.

2. An ink ribbon cartridge as claimed in claim 1, wherein said second portions of said pair of U-shaped leaf springs have integral engaging members and said second wall has a pair of recessed portions engageable with said integral engaging members on an inside surface thereof.

3. An ink ribbon cartridge as claimed in claim 2, wherein said pair of U-shaped leaf springs are made of synthetic resin.

4. An ink ribbon cartridge as claimed in claim 2, wherein said pair of U-shaped leaf springs are made of metal.

5. An ink ribbon cartridge as claimed in claim 1, wherein said second portions of said pair of U-shaped leaf springs have integral engaging members and said second wall has recessed portions engageable with said integral engaging members, said recessed portions being disposed in a predetermined area of an inside surface thereof in which said recessed portions are opposed to said integral engaging members.

6. An ink ribbon cartridge as claimed in claim 5, wherein said pair of U-shaped leaf springs are made of synthetic resin.

7. An ink ribbon cartridge as claimed in claim 1, wherein said pair of U-shaped leaf springs have reverse V-shaped engaging portions bent at said second portions, and said second wall has notches engageable with said reverse V-shaped engaging portions on an inside surface thereof.

8. An ink ribbon cartridge as claimed in claim 1, wherein said pair of U-shaped leaf springs are made of metal.

9. An ink ribbon cartridge as claimed in claim 1, wherein said second wall has a pair of bearing portions of a generally U-shape in section on an inside surface thereof, said bearing portions supporting said second end portions of said pair of spools and being engageable with said second portions of said pair of U-shaped leaf springs.

10. An ink ribbon cartridge as claimed in claim 1, wherein said first end portions have a predetermined diameter, and said second end portions of said pair of spools include middle-diameter sections having a smaller diameter than the diameter of said first end portions and small-diameter sections having a smaller diameter than the diameter of said middle-diameter sections, said middle-diameter sections and said smaller-diameter sections cooperating to form shoulder portions therebetween.

11. An ink ribbon cartridge as claimed in claim 1, wherein said second portions of said pair of U-shaped leaf springs are generally rectangular in plan view.

* * * * *